US010190772B2

(12) United States Patent
Luo et al.

(10) Patent No.: US 10,190,772 B2
(45) Date of Patent: Jan. 29, 2019

(54) DUAL FUEL IGNITION DEVICE AND WORK METHOD THEREOF AS WELL AS SAFETY TYPE DUAL FUEL CONTROL SYSTEM BASED THEREON AND CONTROL METHOD THEREOF

(71) Applicant: ZHEJIANG FUERJ ELECTRIC SCIENCE AND TECHNOLOGY CO., LTD, Ningbo, Zhejiang (CN)

(72) Inventors: Jianfu Luo, Zhejiang (CN); Xueqing Zhao, Zhejiang (CN)

(73) Assignee: ZHEJIANG FUERJ ELECTRIC SCIENCE AND TECHNOLOGY CO. LTD., Zhejiang (CN)

( * ) Notice: Subject to any disclaimer, the term of this patent is extended or adjusted under 35 U.S.C. 154(b) by 406 days.

(21) Appl. No.: 15/000,958

(22) Filed: Jan. 19, 2016

(65) Prior Publication Data

US 2017/0051916 A1 Feb. 23, 2017

(30) Foreign Application Priority Data

Aug. 17, 2015 (CN) ..... 2015 1 0505181
Aug. 17, 2015 (CN) ..... 2015 1 0506869

(51) Int. Cl.
*F23N 5/10* (2006.01)
*F23N 5/24* (2006.01)

(52) U.S. Cl.
CPC ..... *F23N 5/242* (2013.01); *F23N 2025/16* (2013.01); *F23N 2027/26* (2013.01); *F23N 2037/08* (2013.01); *F23N 2039/04* (2013.01)

(58) Field of Classification Search
CPC ..... F23Q 9/00–9/14; F23C 1/08
See application file for complete search history.

(56) References Cited

U.S. PATENT DOCUMENTS

2010/0330513 A1* 12/2010 Deng ..... F16K 11/0836 431/12
2013/0101945 A1* 4/2013 Mulberry ..... F24H 3/00 431/280
2013/0260327 A1* 10/2013 Oliva Aguayo ..... F23N 1/007 431/280
2014/0248567 A1* 9/2014 Deng ..... F23D 17/002 431/42
2015/0338100 A1* 11/2015 Deng ..... F23N 5/242 431/59
2018/0038592 A1* 2/2018 Willis ..... F23N 1/007

* cited by examiner

*Primary Examiner* — Jason Lau
(74) *Attorney, Agent, or Firm* — JCIPRNET

(57) ABSTRACT

The present invention provides a dual fuel ignition device and a work method thereof, wherein the ignition device can output electric potential according to the opposite in-series connection of two thermocouples in a high-heating value gas igniting end and a low-heating value gas igniting end and the heating condition of the thermocouples, and can control the switching on or off of a control valve on a gas flow according to the effective heat electric potential generated by the thermocouples in the process of ignition, so as to avoid the danger condition that the main burner generates high fire caused by the misoperation of the gas appliance, therefore, the safe use can be guaranteed.

18 Claims, 12 Drawing Sheets

DUAL FUEL IGNITION DEVICE AND WORK METHOD THEREOF AS WELL AS SAFETY TYPE DUAL FUEL CONTROL SYSTEM BASED THEREON AND CONTROL METHOD THEREOF

CROSS REFERENCE TO RELATED PATENT APPLICATION

The present application claims priorities of CN 201510505181.8 filed on Aug. 17, 2015 and CN 201510506869.8 filed Aug. 17, 2015, which applications are incorporated herein by reference.

FIELD OF THE INVENTION

The invention relates to the technical field of gas heater, in particular to a dual fuel ignition device and a work method thereof as well as a safety type dual fuel control system based thereon and a control method thereof.

BACKGROUND OF THE INVENTION

There is a plurality of gas supply on the market right now, for example, according to the difference of heating value, there are the propane gas, the natural gas and the like, correspondingly the gas can be divided into the propane gas, the natural gas and the like as well, and there is a gas appliance integrated with a high-heating value gas igniting end and a low-heating value gas igniting end, and the two igniting ends are respectively connected with a corresponding igniting gas flow branch, therefore, not only can a high-heating value gas resource be connected but also a low-heating value gas resource can be connected, however, due to the difference of the heating value of the gas, the aperture of a gas nozzle for the main burner using the low-heating value gas is larger than that of the gas appliance using the high-heating value gas, thus when the low-heating value gas (such as the natural gas) nozzle induces the high-heating value gas (such as the propane gas) by mistake, the fire generated by the gas appliance is too high to be dangerous.

SUMMARY OF THE INVENTION

Aiming at the defects in the prior art, the present invention provides a dual fuel ignition device firstly, wherein the ignition device can output electric potential according to the opposite in-series connection of two thermocouples in a high-heating value gas igniting end and a low-heating value gas igniting end and the heating condition of the thermocouples, and can control the switching on or off of a control valve on a gas flow according to the effective electric potential generated by the thermocouples in the process of ignition, so as to avoid the danger condition that the main burner generates high fire caused by the misoperation of the gas appliance, therefore, the safe use can be guaranteed; furthermore, the present invention provides an ignition device-based safety type dual fuel control system and a control method thereof.

The technical solution of the present invention is realized as follows:

A dual fuel ignition device, comprising:

a high-heating value gas igniting end, comprising a thermocouple and an ignition burner adapted to high-heating value gas, wherein the ignition burner is connected with one branch of a gas inducing gas flow;

a low-heating value gas igniting end, comprising a thermocouple and an ignition burner adapted to low-heating value gas, wherein the ignition burner is connected with the other branch of the gas inducing gas flow;

wherein, anodes and cathodes of the two thermocouples are connected with each other in series oppositely to output electric potential according to the heating condition of the thermocouples; the fire of the ignition burner heats up the corresponding thermocouple only to generate the electric potential when the igniting end correctly induces the gas due to the position configuration of the two thermocouples, and when the igniting end induces the high-heating value gas into the low-heating value igniting end by mistake, the fire heats up the two thermocouples at the same time to offset or reduce the output potential.

Preferably, the opposite in-series connection of the anodes and the cathodes of the two thermocouples means that: the anodes of the two thermocouples are connected with each other in series, and the two cathodes thereof induce the electric potential; or the cathodes of the two thermocouples are connected with each other, and the two anodes thereof induce the electric potential.

Preferably, the high-heating value gas igniting end and the low-heating value gas igniting end respectively comprise an ignition electrode; or the high-heating value gas igniting end and the low-heating value gas igniting end jointly use one ignition electrode.

Preferably, the ignition device comprises a control valve taken as a main switch to control the gas flow switched on or off, wherein the control valve is internally provided with a solenoid valve used for controlling the control valve switched on or off; an output end of the control valve comprises two gas flow output, wherein one is the gas inducing gas flow for switching gear between ignition gas flow of high-heating value gas and low-heating value gas, and the other is a main gas flow leading to a main burner, furthermore, the main gas flow enters into the main burner through an adjustable nozzle and is ignited to be burned on the surface thereof, and the effective gas inlet cross section of the adjustable nozzle is controlled by a selector device used for adjusting the gas flow to the high-heating value gas igniting end or to the low-heating value gas igniting end. The adjustable nozzle is in linkage match with the selector device used for controlling the selector device between the high-heating value gas igniting end and the low-heating value gas igniting end, therefore, when the selector device is adjusted into the different gear, the adjustable nozzle can be automatically adjusted to obtain the corresponding effective gas inlet cross section, thereby being dual-purpose. The effective gas inlet cross section of the nozzle is reduced in case of high-heating value gas, and the effective gas inlet cross section of the nozzle is increased in case of low-heating value gas, so that the rated power of the main burner can be remained.

Preferably, the selector device comprises:

a valve body, wherein a low-heating value gas igniting end gas outlet, a high-heating value gas igniting end gas outlet, a gas igniting end gas flow gas inlet and a main gas inlet are arranged on the periphery of the valve body, the valve body is internally provided with a valve core where the periphery is upwards concaved to be provided with a notch, and the valve core moves to make the notch communicated with the low-heating value gas igniting end gas outlet and the gas igniting end gas flow gas inlet or the high-heating value gas igniting end gas outlet and the gas igniting end gas flow gas inlet;

an adjustable nozzle, which is communicated with a main gas inlet, and arranged at the lower end of the valve body, wherein the lower end of the adjustable nozzle is provided with a nozzle exit;

a valve seat, which is fixedly arranged at the upper end of the valve body, wherein the valve seat is internally provided with an upper valve rod in a sliding way, the upper end of the upper valve rod exposes out of the valve seat, the lower end of the upper valve rod is connected with a lower valve rod, and the lower valve rod penetrates through the valve core to downwards reach the nozzle exit; the valve seat is internally provided with a spring which makes the upper valve rod reset, the upper valve rod downwards moves and drives the valve core move to switch between the high-heating value gas igniting end gas flow and the low-heating value gas igniting end gas flow, and the lower valve rod moves synchronously with the upper valve rod and is matched with the nozzle exit, so that the required effective gas inlet cross section of the nozzle exit corresponding to the high-heating value gas and the low-heating value gas can be adjusted.

Preferably, the valve core and the valve body have taper angle respectively, the lower valve rod is in sliding match with the valve core, the upper end face of the vale core is provided with a housing which is integrated therewith, the spring is covered onto the upper valve rod and is arranged within the housing, a lug boss is arranged on the upper valve rod, the upper end and the lower end of the spring respectively lean against the lug boss and the valve core, a linkage notch matched with the lug boss is arranged on the housing, the valve seat is internally provided with a low-heating value gas gear slot and a high-heating value gas gear slot, which are arranged with each other at different height in a staggered way, the upper valve rod upwards moves to make the lug boss clamped into the linkage notch, the upper valve rod rotates simultaneously to drive the valve core rotated to switch between the high-heating value gas igniting end gas flow and the low-heating value gas igniting end gas flow, and the lug boss is clamped into the corresponding gear slot to position the lower valve rod as well. The valve core has the taper angle, thereby being arranged within the valve body by means of axial fixation and circumferential rotation, the hermetic seal is kept between the valve core and the inner wall of the valve body, the spring is used for positioning the valve core in a leaning way through the elasticity to make hermetic seal kept between the valve core and the valve body, and the spring offers a reset force for moving the upper valve rod. The upper valve rod downwards moves and rotates, so that the valve core can be adjusted by different gears, and the lug boss on the upper valve rod is clamped into the corresponding gear slot, so that the lower valve rod can be positioned, therefore, the dual fuel ignition device is ingenious to design, the gear of the igniting end and the effective gas inlet cross section of the main burner can be adjusted at the same time, thus, the dual fuel ignition device is dual-purpose.

Preferably, the cross section of the notch is arc, the low-heating value gas igniting end gas outlet and the high-heating value gas igniting end gas outlet are arranged on the same straight line, and the igniting end gas inlet is arranged along the direction which is perpendicular to the straight line where the high-heating value gas igniting end gas outlet and the low-heating value gas igniting end gas outlet are arranged. The cross section of the notch is selected as the fan-shaped surface with 90 degrees preferably, therefore, due to the configuration, the gas igniting end gas flow inlet can be respectively communicated with the high-heating value gas igniting end gas outlet and the low-heating value gas igniting end gas outlet only by rotating the valve core at 90 degrees.

Preferably, the valve core is arranged within the valve body up and down in a sliding way, the lower valve rod is fixedly connected with the valve core, the low-heating value gas igniting end gas outlet and the high-heating value gas igniting end gas outlet as well as the gas igniting end gas flow inlet are arranged along the axial direction of the center of the valve core, and the gas igniting end gas inlet is arranged between the low-heating value gas igniting end gas outlet and the high-heating value gas igniting end gas outlet; the upper end of the valve body is contracted into a support table, the lug boss is arranged on the upper valve rod, the spring is covered onto the upper valve rod, the upper end and the lower end of the spring respectively lean against the support table and the lug boss, the valve seat is internally provided with a low-heating value gas gear slot and a high-heating value gas gear slot, which are arranged with each other at different height in a staggered way, the upper valve rod downwards moves to make the lower valve rod and the valve core linked and to switch between the high-heating value gas igniting end and the low-heating value gas igniting end, and the upper valve rod rotates to make the lug boss correspondingly clamped into the different gear slots so as to position the lower valve rod and the valve core. Due to the manner, the selector device can be realized by the means that the valve core slides along the axial direction of the upper valve rod and the lower valve rod, and the gas charge and the gas discharge of the gas flow cannot be influenced due to the size of the notch when the upper valve rod rotates to the different gear slots to be positioned.

Preferably, the lower end of the lower valve rod is tapered, in case of low-heat vale gear, the lower end of the lower valve rod departs away from the nozzle exit, and in case of high-heating value gear, the lower end of the lower valve rod is inserted into the nozzle exit, so that the effective gas inlet cross section of the nozzle exit is changed. In such manner, the nozzle exist is provided with one gas hole, and the taper-shaped part at the lower end of the lower valve rod enters into the nozzle exit, so that the nozzle exit is changed into the gas inlet with ring-shaped cross section from the gas inlet with circular cross section, therefore, the aim for adjusting the effective gas inlet cross section can be achieved.

Preferably, the lower end of the lower valve rod is cylindrical, the diameter of the lower end of the lower valve rod is less than that of the nozzle exit, and in case of low-heat vale gear, the lower end of the lower valve rod departs away from the nozzle exit; in case of high-heating value gear, the lower end of the lower valve rod is inserted into the nozzle exit, so that the effective gas inlet cross section of the nozzle exit is changed. In such manner, the nozzle exist is provided with one gas hole, the lower end of the lower valve rod is cylindrical, and the cylinder enters into the nozzle exit, so that the nozzle exit is changed into the gas inlet with circular cross section from the gas inlet with ring-shaped cross section, therefore, the aim for adjusting the effective gas inlet cross section can be achieved.

Preferably, the lower end of the lower valve rod is cylindrical, the nozzle exist is provided with a plurality of gas holes, the lower end of the lower valve rod is provided with an O-shaped seal ring in a covering way, and in case of low-heat valve gear, the lower valve rod departs away from the nozzle exit, so that all the gas holes are communicated with one another; in case of high-heating value gear, the lower valve rod downwards moves, so that one gas hole is plugged by the lower end of the lower valve rod, therefore, the effective gas inlet cross section of the nozzle exit can be changed. In such manner, the nozzle exit is provided with the plurality of gas holes, for example, the nozzle exit consists of a main gas hole in the middle and a plurality of subsidiary gas holes distributed around the main gas hole, and the main gas hole is plugged by the cylinder at the lower end when the lower valve rod downwards moves, so that the subsidiary gas holes are communicated with one another, therefore, the aim for adjusting the effective gas inlet cross section can be achieved as well due to such manner.

Preferably, the lower end of the lower valve rod is tapered, the nozzle exist is provided with the plurality of gas holes, in case of low-heat valve gear, the lower valve rod departs away from the nozzle exit, so that all the gas holes are communicated with one another, and in case of high-heating value gear, the lower valve rod downwards moves, so that one gas hole is plugged by the lower end of the lower valve rod, therefore, the effective gas inlet cross section of the nozzle exit is changed. Similarly to the aforementioned manner, the clearance error between the cylinder and the gas holes can be effectively eliminated only by designing the lower end of the lower valve rd to be tapered.

Preferably, the lower part of the lower valve rod is contracted into a push rod, the upper end of the push rod is fixedly provided with a baffle ring, the lower end of the push rod is movably provided with a seal cushion in a covering way, a spring is arranged on the push rod in a covering way, the upper end and the lower end of the spring respectively lean against the baffle ring and the seal cushion, the nozzle exit is provided with the plurality of gas holes, and in case of low-heating value gear, the lower valve rod upwards moves to drive the seal cushion depart away from the nozzle exit, so that all the gas holes are communicated with one another; in case of high-heating value gear, the lower valve rod downwards moves to make the seal cushion tightly press at the corresponding gas hole by the spring, so that the effective gas inlet cross section of the nozzle exist can be reduced. Due to the manner, the seal cushion leans against the corresponding gas hole, and the sealing cushion is tightly pressed by the spring, so that the air leakage can be avoided, and the tightness can be guaranteed.

A work method based on the ignition device, comprising:

when the igniting end induces the gas correctly, only the corresponding thermocouple can be heated up, so that the electric potential generated by the thermocouple makes a solenoid valve in a control valve switched on, therefore, the gas flow is communicated, when the oxygen content of the atmosphere falls below a specific level, the igniting gas is changed to be unstable and even extinguished, and the electro-dynamic electric potential generated by the thermocouple is reduced and even disappeared, so that the solenoid valve in the control valve is released, the gas flow is not communicated, and the gas heater stop working, thus, the safety can be guaranteed;

when the high-heating value gas igniting end induces the low-heating value gas by mistake, the ignition burner cannot be ignited or the thermocouple cannot be heated due to less fire, the thermocouple cannot generate the potential, and the solenoid valve in the control valve cannot be switched on, so that the gas flow is not communicated;

when the high-heating value gas is induced into the low-heating value gas igniting end induces by mistake, the fire jet out of the ignition burner of the low-heating value gas igniting device can be changed to be long abnormally, to heat up the two thermocouples at the same time, the two thermocouples can simultaneously generate the electric potential which can be offset and reduced, and the solenoid valve in the control valve cannot be switched on as well, therefore, the gas flow is not communicated.

An ignition device-based safety type dual fuel control system, comprising a low-heating value regulator, a high-heating value regulator and:

a control valve, used for controlling the gas flow to be switched on and off, and respectively communicated with the low-heating value regulator and the high-heating value regulator, wherein the control valve is provided with two gas flow output, one is the igniting gas, the other is the main gas flow leading to the main burner, and the igniting gas leads to the high-heating value gas igniting end or the low-heating value gas igniting end by means of selector device;

the high-heating value gas igniting end and the low-heating value gas igniting end respectively comprise an ignition electrode; or the high-heating value gas igniting end and the low-heating value gas igniting end jointly use one ignition electrode; the high-heating value gas igniting end and the low-heating value gas igniting end further respectively comprise a thermocouple and an ignition burner which is respectively adapted to high-heating value gas and low-heating value gas, and anodes and cathodes of the two thermocouples are connected with the solenoid valve in the control valve after being connected with each other in series oppositely; the fire of the ignition burner heats up the corresponding thermocouple only to generate the electric potential when the system correctly induces the gas due to the position configuration of the two thermocouples, so that the solenoid valve of the control valve can be kept to be switched on, and when the system induces the high-heating value gas into the low-heating value igniting end by mistake, the fire heats up the two thermocouples at the same time to offset or reduce the potential, so that the control valve is kept to be switched off.

Preferably, the in-series connection between the anodes as well as the cathodes of the two thermocouples and the solenoid valve in the control valve after the opposite in-series connection between the anodes and the cathodes of the two thermocouples means that: the anodes of the two thermocouples are connected with each other in series, and the two cathodes are lead out to be connected with the solenoid valve in the switch control vale in series; or the cathodes of the two thermocouples are connected with each other in series, and the anodes are lead out to be connected with the solenoid valve in the switch control vale in series.

Preferably, the ignition burner of the low-heating value gas ignition device is internally provided with an air window and a gas nozzle which is over against the air window, when the gas is jet out of the gas nozzle, the air window can generate the negative-pressure injection, a certain quantity of air can be charged to be mixed with the gas within the ignition burner so as to be jet out of the nozzle on the ignition burner and formed into the igniting fire by means of burning after being ignited by the ignition electrode.

A work method based on the ignition device, comprising:

when the system induces the gas correctly, only the corresponding thermocouple can be heated up, so that the electric potential generated by the thermocouple makes the solenoid valve in the control valve switched on, therefore, the gas flow is communicated;

when the system induces the low-heating value gas into the high-heating value gas igniting end by mistake, the ignition burner cannot be ignited or the thermocouple cannot be heated due to less fire, the thermocouples cannot generate the potential, and the solenoid valve in the control valve cannot be switched on, therefore, the gas flow is not communicated;

When the system induces the high-heating value gas into the low-heating value gas igniting end by mistake, the fire jet out of the ignition burner of the low-heating value gas ignition device can be changed to be long abnormally, to heat up the two thermocouples at the same time, the two thermocouples can simultaneously generate the electric potential which can be offset or reduced, and the solenoid valve in the control valve cannot be switched on as well, therefore, the gas flow is not communicated.

Preferably, when is system is correctly set, if the oxygen content of the atmosphere falls below a specific level, the igniting gas is changed to be unstable and even extinguished, and the electro-dynamic potential generated by the thermocouples is reduced and even disappeared, so that the solenoid valve in the control valve which is connected with the thermocouple in series is released, the gas flow is not communicated, and the gas heater stop working, therefore, the safety can be guaranteed.

Industrial Applicability and Advantageous Effects

By adopting the technical solution, the present invention has the following design idea and beneficial effect:

the present invention firstly provides a dual fuel ignition device and a work method thereof, wherein the ignition device can output electric potential according to the opposite in-series connection of two thermocouples in a high-heating value gas igniting end and a low-heating value gas igniting end and the heating condition of the thermocouples, and can control the switching on or off of a control valve on a gas flow according to the effective heat electric potential generated by the thermocouples in the process of ignition, so as to avoid the danger condition that the main burner generates high fire caused by the misoperation of the gas appliance, therefore, the safe use can be guaranteed.

Specifically, the size of the aperture of the nozzle of the ignition burners in the high-heating value gas igniting end is different from that in the low-heating value gas igniting end, which are adapted to the high gas and the low gas respectively, so that when the system induces the gas correctly, only the corresponding thermocouple is heated, and the electric potential generated by the thermocouple makes the solenoid valve in the control valve switched on, therefore, the gas flow is communicated; when the system induces the low-heating value gas into the high-heating value gas igniting end by mistake, the nozzle of the ignition burner in the high-heating value gas igniting end is designed according to the standard for jetting the high-heating value gas (such as the propane gas), so that excessive air can be induced when the low-heating value gets through the ignition burner of the high-heating value gas igniting end, the gas cannot be ignited as the ignitable air-fuel ratio of the low-heating value gas is excessive, the thermocouple cannot generate the electric potential, and the solenoid valve in the control valve cannot be switched on, therefore, the gas flow is switched off; when the system induces the high-heating value gas into the low-heating value gas igniting end by mistake, the nozzle of the ignition burner in the low-heating value gas igniting end is designed according to the standard of the low-heating value gas (such as the natural gas), so that the aperture of the nozzle is larger, and the pressure of the high-heating value gas is higher, thus, the fire jet out of the ignition burner of the low-heating value gas igniting device can be changed to be long abnormally, to heat up the two thermocouples at the same time, the two thermocouples can simultaneously generate the electric potential which can be offset or reduced, and the solenoid valve in the control valve cannot be switched on as well, therefore, the gas flow is not communicated.

Furthermore, the present invention ignites the main burner through the fire jet out of the ignition burner and heats up the corresponding thermocouple, and controls whether the solenoid valve in the control valve switched on or not according to the effective electric potential generated by the thermocouple, wherein, when the system induces the gas correctly, the fire of the ignition burner is changed into pilot flame to persistently heat up the corresponding thermocouple, and the solenoid valve of the control valve can be persistently switched on due to the persistently generated electric potential to keep the valve switched on, therefore, the solenoid valve can be controlled only by adding battery to igniting components without externally connecting electric supply or adding battery to the switch control vale, thus, the electric energy can be effectively saved, and the after-use worries of users can be eliminated.

DETAILED DESCRIPTION OF THE PREFERRED EMBODIMENTS

Figure 1:
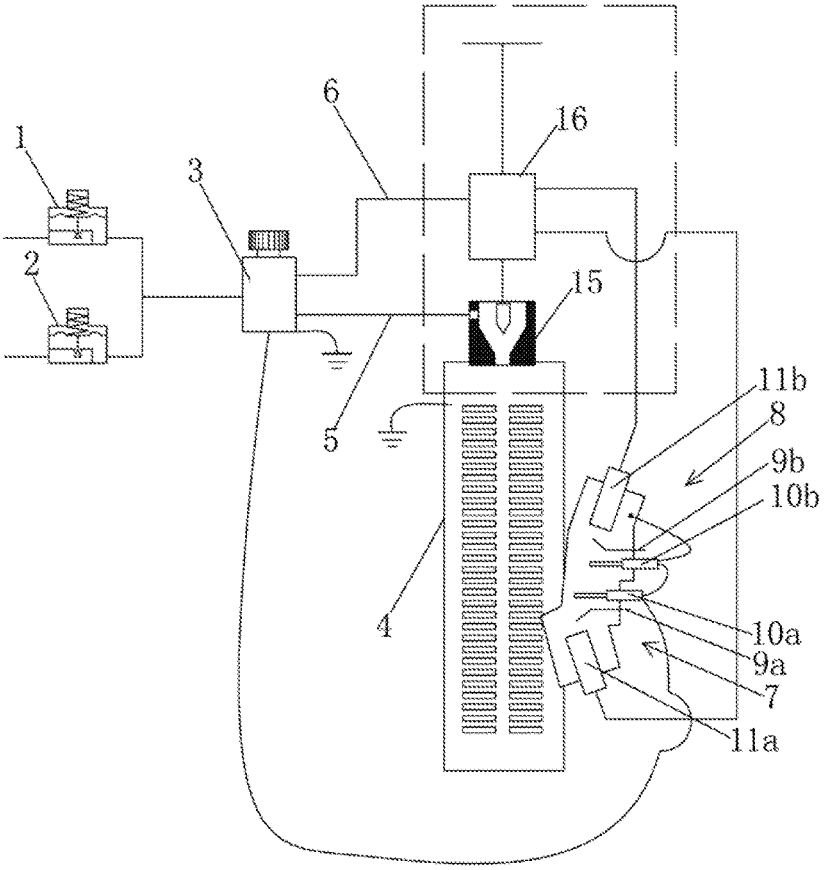
FIG. 1 is the overall structure schematic diagram of the control system of the present invention in embodiment 1.

The specific embodiments of the present invention are as follows:

Embodiment 1: as shown in FIG. 1, a dual fuel ignition device comprises:

A high-heating value gas igniting end 7, comprising a thermocouple 10*a* and an ignition burner 11*a* adapted to the high-heating value gas, wherein the ignition burner 11*a* is connected with the other branch of the gas inducing gas flow;

a low-heating value gas igniting end 8, comprising a thermocouple 10*b* and an ignition burner 11*b* adapted to the low-heating value gas, wherein the ignition burner is connected with the other branch of the gas inducing gas flow;

wherein, the electric potential can be output according to the heating condition of the thermocouples after anodes and cathodes of the two thermocouples 10*a* and 10*b* are oppositely connected with each other in series; the fire of the ignition burner heats up the corresponding thermocouple only to generate the electric potential when the igniting end correctly induces the gas due to the position configuration of the two thermocouples 10*a* and 10*b*, and when the igniting end induces the high-heating value gas into the low-heating value igniting end by mistake, the fire heats up the two thermocouples 10 and 10*b* at the same time to offset or reduce the output potential.

The opposite in-series connection of the anodes and the cathodes of the two thermocouples means that: the anodes of the two thermocouples 10*a* and 10*b* are connected with each other in series, and the two cathodes thereof induce the potential; the cathodes of the two thermocouples 10*a* and 10*b* are connected with each other in series, and the two anodes thereof induce the potential. The high-heating value gas igniting end 7 and the low-heating value gas igniting end 8 comprise an ignition electrode respectively; or the high-heating value gas igniting end and the low-heating value gas igniting end jointly use one ignition electrode.

The dual fuel ignition device disclosed by the present invention is an important constituent part of a safety type dual fuel control system in the embodiment, as shown in FIG. 1-FIG. 27, the safety type dual fuel control system comprises a low-heating value regulator 1, a high-heating value regulator 2 and:

a control valve 3, taken as a main switch of the gas flow to control the gas flow to be switched on and off, and respectively connected with the low-heating value regulator 1 and the high-heating value regulator 2, wherein the control valve 3 is provided with two gas flow output, one is the igniting gas flow 6, the other is the main gas flow 5 leading to the main burner 4, and the igniting gas flow leads to the high-heating value gas igniting end 7 or the low-heating value gas igniting end 8 by means of selector device;

the high-heating value gas igniting end 7 and the low-heating value gas igniting end 8 respectively comprises an ignition electrode 9*a* and 9*b*, thermocouples 10*a* and 10*b* and ignition burners 11*a* and 11*b* which are respectively adapted to the high-heating value gas and the low-heating value gas, wherein anodes and cathodes of the two thermocouples 11*a* and 10*b* are connected with each other in series oppositely, and are connected with the solenoid valve in the control valve 3; the fire of the ignition burner heats up the corresponding thermocouple only to generate the electric potential so as to make the solenoid valve of the control valve switched on to be communicated when the system induces the gas correctly due to the position configuration of the two thermocouples 10*a* and 10*b*, and when the system induces the high-heating value gas into the low-heating value igniting end by mistake, the fire heats up the two thermocouples at the same time to offset or reduce the output electric potential so as to make the control valve kept switched off;

an igniting control component (which is not shown in Figs), comprising an igniting button as well a battery box and an impulse igniter, which are respectively connected with the igniting button through conductive wires, wherein the battery box supplies power supply for the impulse igniter, and the impulse igniter is connected with the two ignition electrodes 9*a* and 9*b*.

Figure 2:
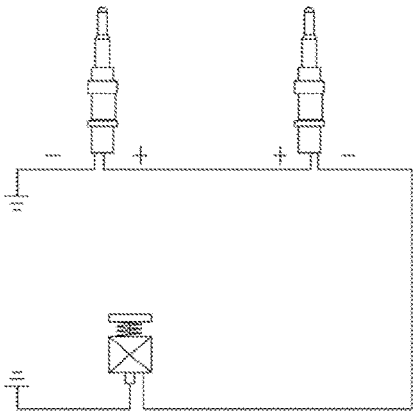
FIG. 2 is the equivalent circuit diagram of the circuit connection between the two thermocouples and the solenoid valve in the control valve.
Figure 3:
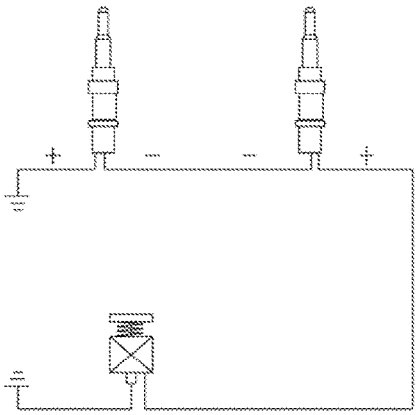
FIG. 3 is the equivalent circuit diagram of the other connection type between the two thermocouples and the solenoid valve in the control valve.
Figure 4:
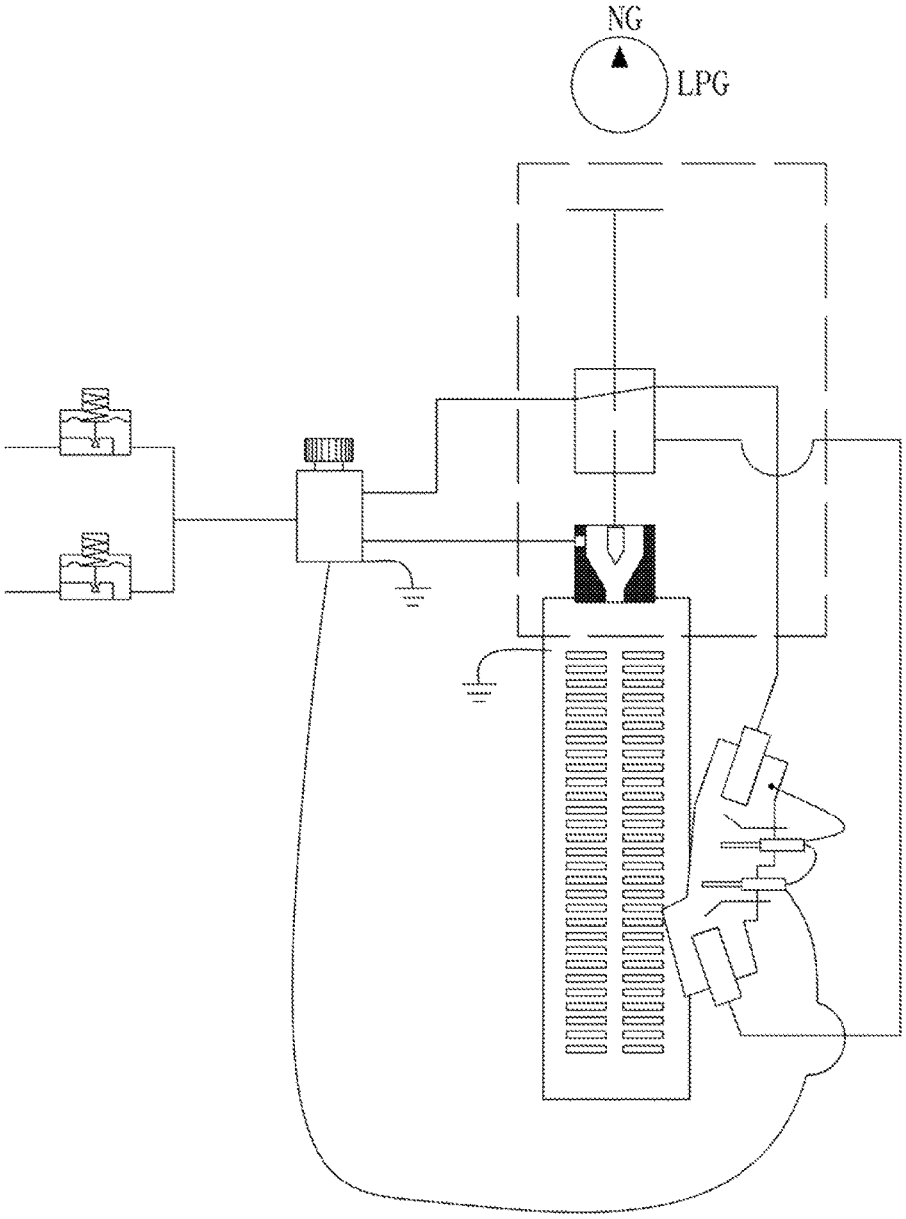
FIG. 4 is the diagram when the gear of the control system is switched to the low-heating value gas igniting end.
Figure 5:
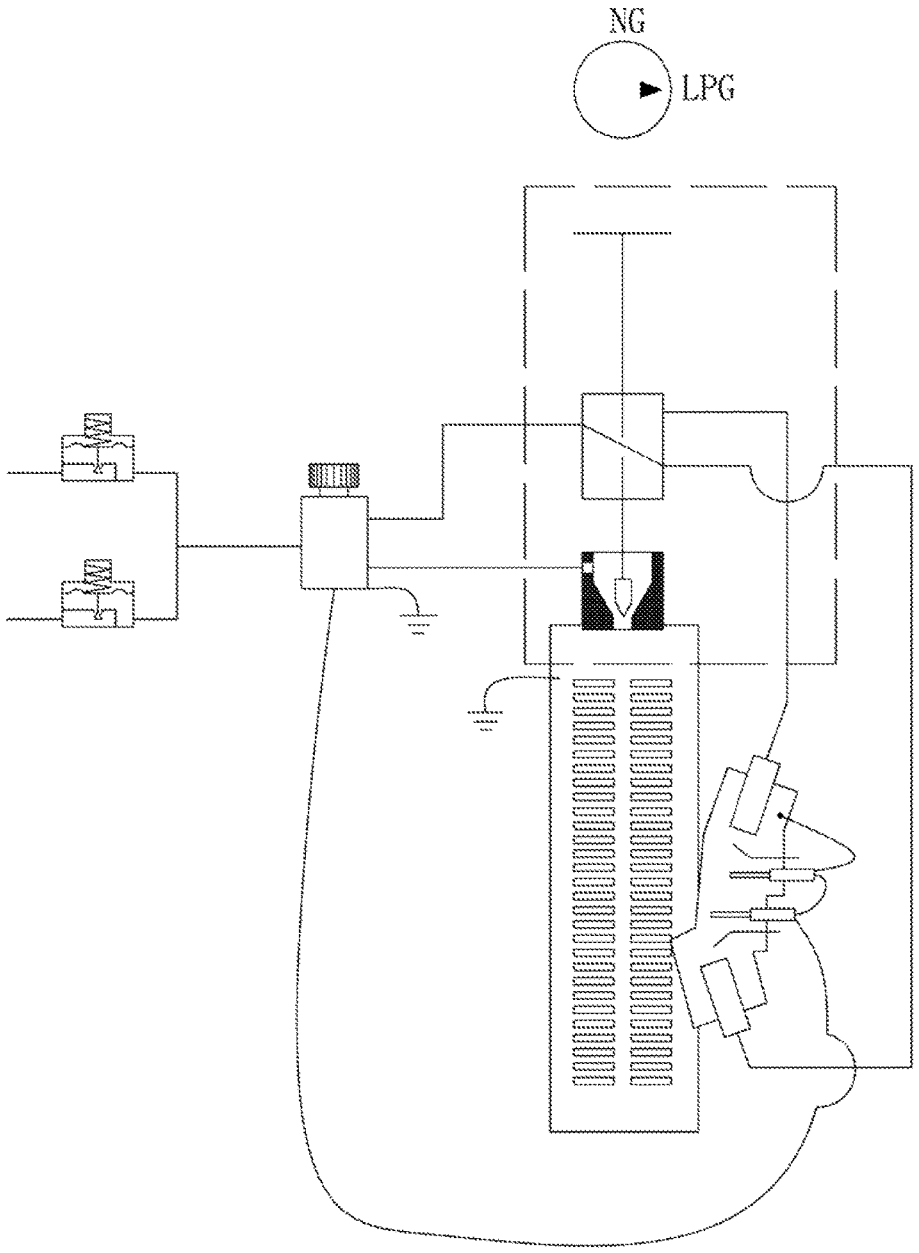
FIG. 5 is the diagram when the gear of the control system is switched to the high-heating value gas igniting end.

As shown in FIG. 2 and FIG. 3, the connection method that the two thermocouples 10*a* and 10*b* are connected with each other in series oppositely and are connected with the solenoid valve in the control valve 3 in series at the same time means that: anodes of the two thermocouples are connected with each other in series, and two cathodes are induced to be connected with the solenoid valve in the control valve in series; or cathodes of the two thermocouples are connected with each other in series, and two anodes are induced to be connected with the solenoid valve in the control valve in series.

Figure 6:
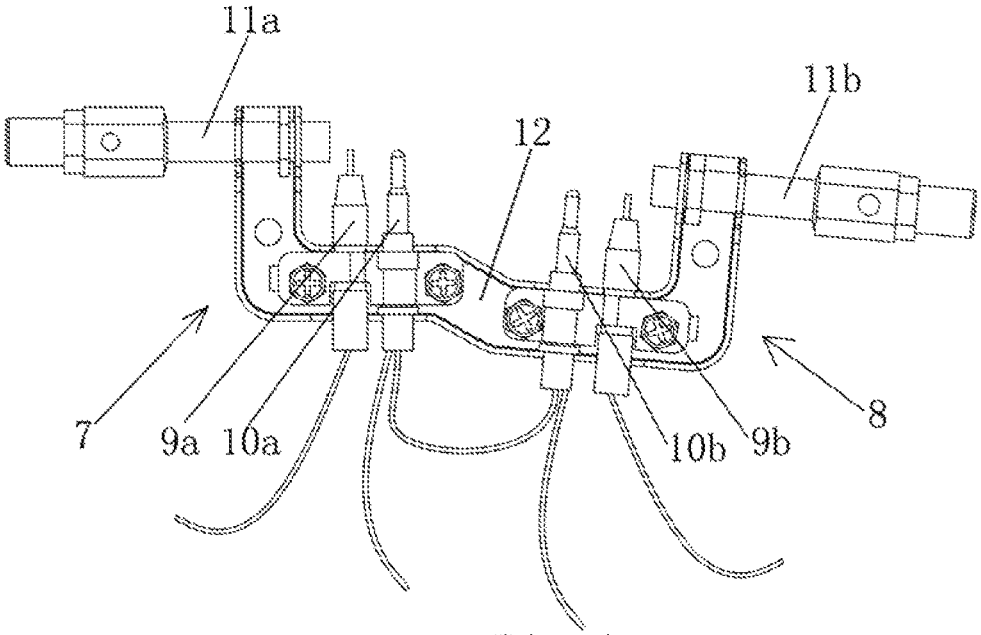
FIG. 6 is the diagram of the installation structure of the high-heating value gas igniting end and the low-heating value gas igniting end.
Figure 7:
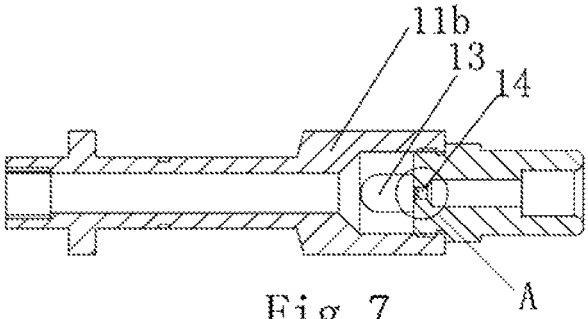
FIG. 7 is the diagram of the inner structure of the ignition burner in the low-heating value gas igniting end.
Figure 8:
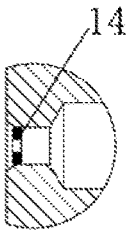
FIG. 8 is the enlarged drawing of part A of FIG. 7.

As shown in FIG. 6, the high-heating value gas igniting end 7 and the low-heating value gas igniting end 8 are jointly fixed on one support 12, the ejector 11*b* of the low-heating value gas igniting end 8 is internally provided with an air window 13 and a gas nozzle 14 which is over against the air window 13, when the gas is jet out of the gas nozzle 14, the air window can generate the negative-pressure injection, so that a certain quantity of air can be charged to be mixed with the gas within the ignition burner so as to be jet out of the nozzle on the ignition burner, and formed into the igniting fire by means of burning after being ignited by the ignition electrode.

As shown in FIG. 1, the main gas flow 5 enters into the main burner 4 through an adjustable nozzle 15 and is ignited to be burned on the surface thereof, and the effective gas inlet cross section of the adjustable nozzle 15 is controlled by a selector device which is used for adjusting the gas flow to the high-heating value gas igniting end 7 or to the low-heating value gas igniting end 8.

Specifically, as shown in FIG. 15-FIG. 25, the selector device is described according to the state of vertical arrangement, wherein the selector device 16 comprises:

a valve body 17, wherein a low-heating value gas igniting end gas outlet 18, a high-heating value gas igniting end gas outlet 19, a gas igniting end gas flow gas inlet 20 and a main gas inlet 21 are arranged on the periphery of the valve body 17, the valve body 17 is internally provided with a valve core 23 where the periphery is upwards concaved to be provided with a notch 22, the cross section of the notch 22 is arc, the low-heating value gas igniting end gas outlet 18 and the high-heating value gas igniting end gas outlet 19 are arranged on the same straight line, the igniting end gas inlet 20 is arranged along the direction which is perpendicular to the straight line where the high-heating value gas igniting end gas outlet 18 and the low-heating value gas igniting end gas outlet 19 are arranged, and the main gas inlet 21 as well as the high-heating value gas igniting end gas outlet 18 and the low-heating value gas igniting end gas outlet 19 are arranged along the height direction of the valve body 17 in a staggered way up and down; the valve core 23 rotates to make the notch 22 communicated with the low-heating value gas igniting end gas outlet 18 and arranged with the low-heating value gas igniting end gas outlet 18 and the high-heating value gas igniting end gas outlet 19 in a staggered way up and down, and the gas igniting end gas flow gas inlet 20 is communicated with the high-heating value gas igniting end gas outlet 19 or the gas igniting end gas flow gas inlet 20;

an adjustable nozzle 15, which is communicated with a main gas inlet 21, and arranged at the lower end of the valve body 17, wherein the lower end of the adjustable nozzle 15 is provided with a nozzle exit 24;

a valve seat 25, which is fixedly arranged at the upper end of the valve body 17 in the manner of riveting connection or screw connection, wherein the valve seat 25 is internally provided with an upper valve rod 26 in a sliding way, the upper end of the upper valve rod 26 exposes out of the valve seat 25, the lower end of the upper valve rod 26 is fixedly connected with a lower valve rod 27, and the lower valve rod 27 penetrates through the valve core 23 to downwards reach the nozzle exit 24; the valve seat 25 is internally provided with a spring 28 which makes the upper valve rod 26 reset, the upper valve rod 26 downwards moves and drives the valve core 23 move to switch between the high-heating value gas igniting end gas flow and the low-heating value gas igniting end gas flow, and the lower valve rod 27 moves synchronously with the upper valve rod 26 and is matched with the nozzle exit 24, so that the required effective gas inlet cross section corresponding to the high-heating value gas and the low-heating value gas of the nozzle exit 24 can be adjusted.

Furthermore, the valve core 23 and the valve body 17 have taper angle respectively, the lower valve rod 27 is in sliding match with the valve core 23, the hermetic seal is kept between the lower valve rod 27 and the valve core 23, the upper end face of the vale core 23 is provided with a housing 29 integrated therewith, the spring 28 is covered onto the upper valve rod 26 and is arranged within the housing 29, a lug boss 30 is arranged on the upper valve rod 26, the upper end and the lower end of the spring 28 respectively lean against the lug boss 30 and the valve core 23, and a linkage notch 31 matched with the lug boss 30 is arranged on the housing 29; as shown in FIG. 22-FIG. 25, the cross section of the valve seat 25 is arc, the valve seat 25 is internally provided with a low-heating value gas gear slot 32 and a high-heating value gas gear slot 33, which are arranged with each other at different height in a staggered way, the upper valve rod 26 downwards moves to make the lug boss 30 clamped into the linkage notch 31, the upper valve rod 26 rotates simultaneously to drive the valve core 23 rotated so as to switch between the high-heating value gas igniting end gas flow and the low-heating value gas igniting end gas flow, and the lug boss 30 is clamped into the corresponding gear slot as well to position the upper valve rod 26 and the lower valve rod 27.

Figure 26:
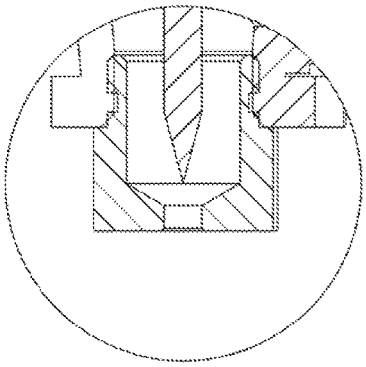
FIG. 26 and FIG. 27 are the structure schematic diagrams of the match between the lower valve rod and the nozzle in embodiment 1.
Figure 27:
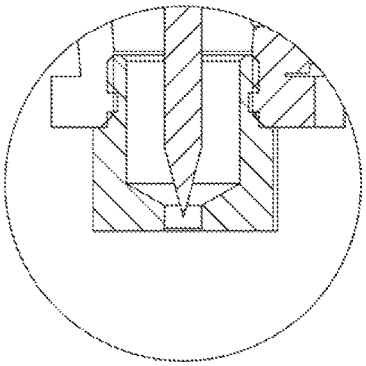

As shown in FIG. 26, the lower end of the lower valve rod 27 is tapered, and in case of low-heat vale gear, the lower end of the lower valve rod departs away from the nozzle exit 24; as shown in FIG. 27, in case of high-heating value gear, the lower end of the lower valve rod 27 is inserted into the nozzle exit 24, so that the effective gas inlet cross section of the nozzle exit 24 is changed, specifically, the gas inlet cross section of the nozzle exit 24 is changed in to the shape of ring from circle, therefore, the effective gas inlet cross section is reduced, and the high-heating value gas with higher pressure can be adapted.

Figure 9:
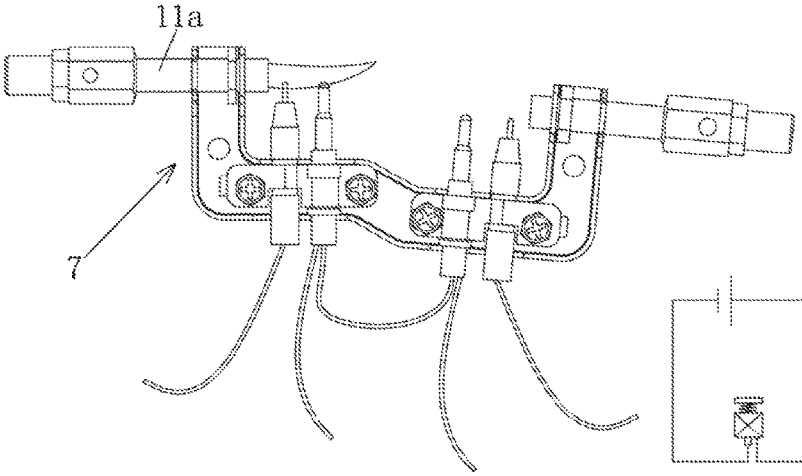
FIG. 9 is the state diagram when the high-heating value gas igniting end burns if the system induces the gas correctly.
Figure 10:
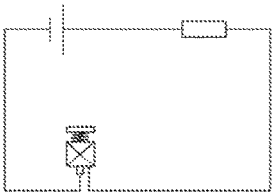
FIG. 10 is the equivalent circuit diagram of FIG. 9.

A solenoid valve of an initial control valve is under the un-switched normal close state, when the system induces the high-heating value gas correctly, as shown in FIG. 9 and FIG. 10, only the corresponding thermocouple can be heated, the thermocouple corresponding to the low-heating value gas igniting end is connected with a resistor equally in series in the circuit, the resistance of the thermocouple is less, so that the influence is less, and the electric potential generated by the fire-heated thermocouple makes the solenoid valve of the thermocouple switched on, therefore, the gas flow is communicated to make the safety control electric circuit capable of normally working.

Figure 11:
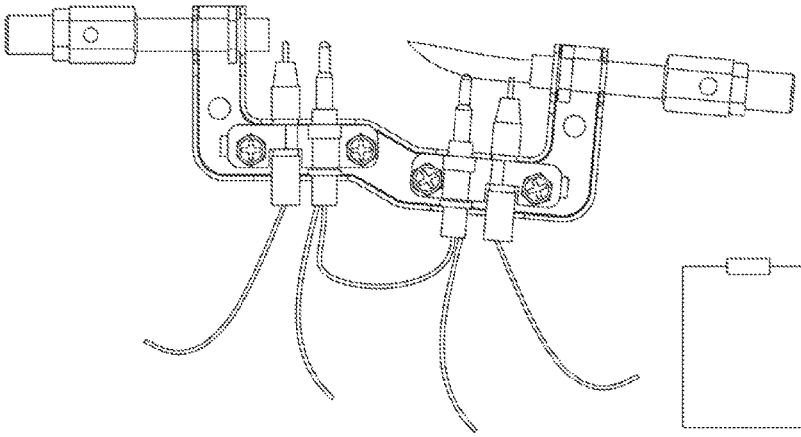
FIG. 11 is the state diagram when the low-heating value gas igniting end burns if the system induces the gas correctly.
Figure 13:
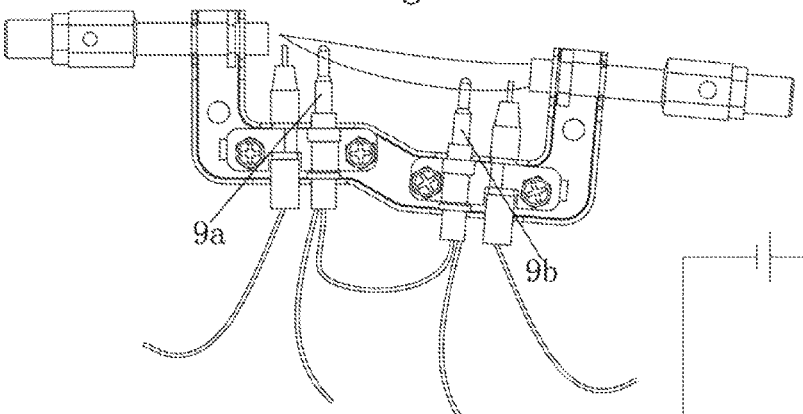
FIG. 13 is the state diagram when the low-heating value gas igniting end burns if the system induces the high-heating value gas into the low-heating value gas igniting end by mistake.

As shown in FIG. 9, FIG. 11 and FIG. 13, the high-heating value gas igniting end and the low-heating value gas igniting end are arranged at the same side of the main burner, the two thermocouples and the ignition burners which are adjoining therewith respectively are arranged in the manner of verticality or approximate verticality, when the gas is induced correctly, the fire jet out of the corresponding ignition burner heat up the adjoining thermocouple, and when the high-heating value gas is induced into the low-heating value gas igniting end by mistake, the fire jet out of the ignition burner heats up the two thermocouples at the same time, therefore, the aim can be achieved by the position configuration of the two thermocouples and the distance measurement of the fire length.

Figure 12:
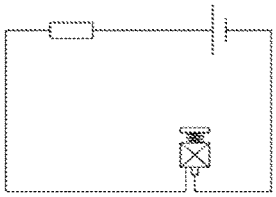
FIG. 12 is the equivalent circuit diagram of FIG. 11.

When the control system induces the low-heating value gas correctly, as shown in FIG. 11 and FIG. 12, only the corresponding thermocouple can be heated, the thermocouple corresponding to the high-heating value gas igniting end is connected with a resistor equally in series in the circuit, the resistance of the thermocouple is less, so that the influence is less, and the electric potential generated by the fire-heated thermocouple makes the solenoid valve of the thermocouple switched on, therefore, the gas flow is communicated to make the safety control electric circuit capable of normally working. When in use, if the oxygen content of the atmosphere falls below a specific level, the igniting gas is changed to be unstable and even extinguished, and the electro-dynamic potential generated by the thermocouple is reduced and even disappeared, so that the solenoid valve in the control valve connected therewith in series is released, the gas flow is not communicated, and the gas heater stop working, therefore, the safety can be guaranteed.

Figure 14:
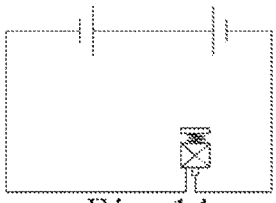
FIG. 14 is the equivalent circuit diagram of FIG. 13.
Figure 15:
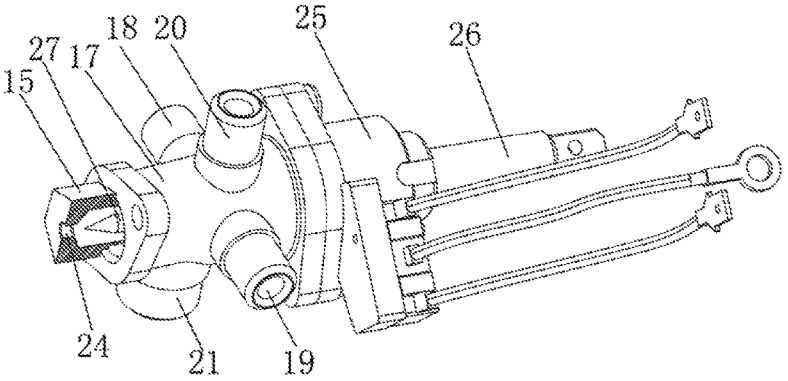
FIG. 15 is the three-dimensional structure schematic diagram of the selector device.
Figure 16:
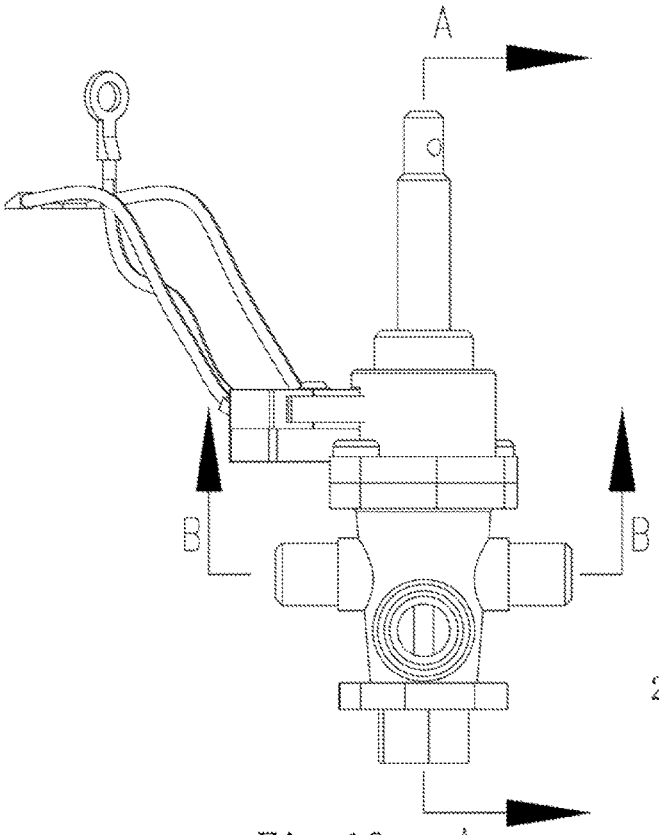
FIG. 16 is the plane structure schematic diagram of the selector device.
Figure 17:
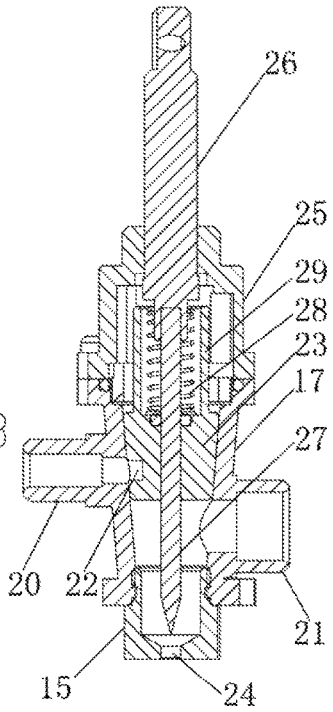
FIG. 17 is A-A section view of FIG. 16.
Figure 18:
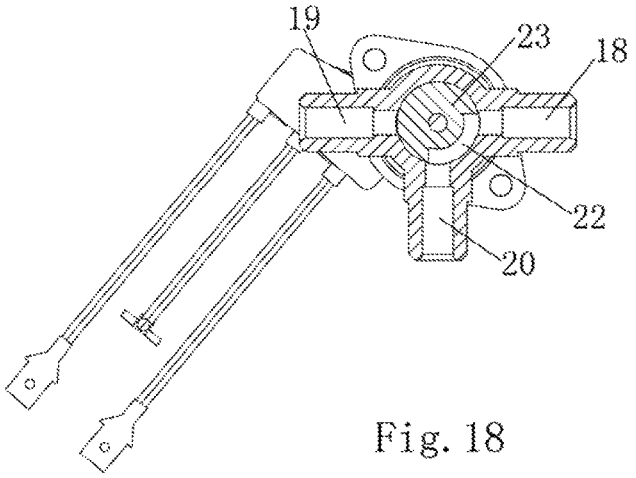
FIG. 18 is B-B section view of FIG. 16.
Figure 19:
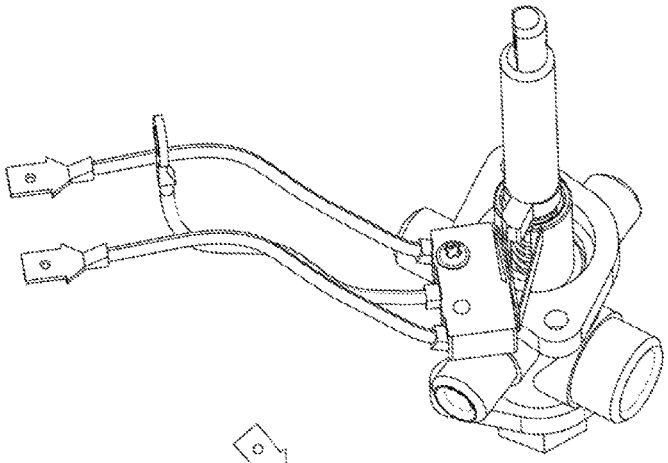
FIG. 19 is the three-dimensional structure schematic diagram of the other angle of the selector device.

When the system induces the high-heating value gas into the low-heating value gas igniting end by mistake, as shown in FIG. 13 and FIG. 14, the fire of the low-heating value gas igniting end can be changed to be long abnormally, to heat up the two thermocouples 9*a* and 9*b* at the same time, the two thermocouples can simultaneously generate the potential, and due to the opposite in-series connection, the electro-dynamic electric potential acted onto the solenoid valve in the in-series circuit can be very low, nearly being equal to offset mutually, so that the solenoid valve cannot be switched, therefore, the gas flow cannot be normally opened, and the gas appliance cannot work, thus, the safety can be guaranteed.

when the system induces the low-heating value gas into the high-heating value gas igniting end by mistake, low-heating value gas can induces the excessive air through the ignition burner of the high-heating value gas igniting end, and the ignitable air-fuel ratio of the low-heating value gas is excessive, so that the gas cannot be ignited as, the thermocouple cannot generate the electric potential as well, the solenoid valve in the control valve cannot be switched on, and the gas flow is switched off; the gas appliance cannot work as well, thus, the safety can be guaranteed.

Figure 28:
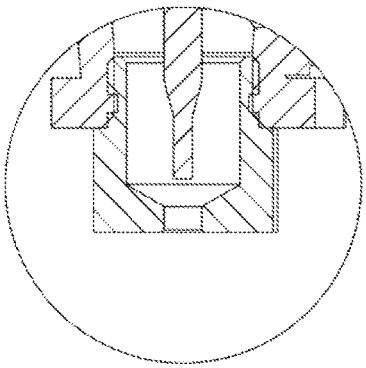
FIG. 28 and FIG. 29 are the structure schematic diagrams of the match between the lower valve rod and the nozzle in embodiment 2.
Figure 29:
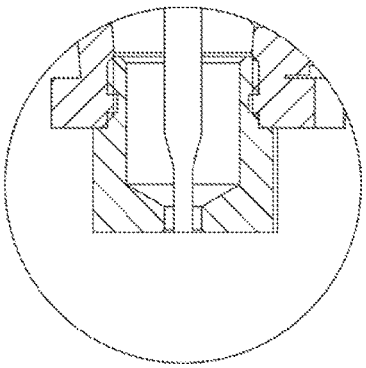

Embodiment 2: different from embodiment 1, as shown in FIG. 28 and FIG. 29, the lower end of the lower valve rod is cylindrical, the diameter of the lower end of the lower valve rod is less than the size of the aperture of the nozzle exit, and in case of low-heat vale gear, the lower end of the lower valve rod departs away from the nozzle exit; in case of high-heating value gear, the lower end of the lower valve rod is inserted into the nozzle exit, so that the effective gas inlet cross section of the nozzle exit is changed.

Figure 30:
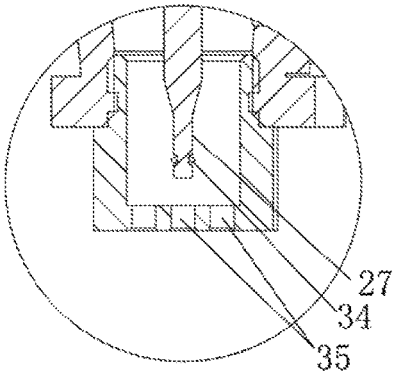
FIG. 30 and FIG. 31 are the structure schematic diagrams of the match between the lower valve rod and the nozzle in embodiment 3.
Figure 31:
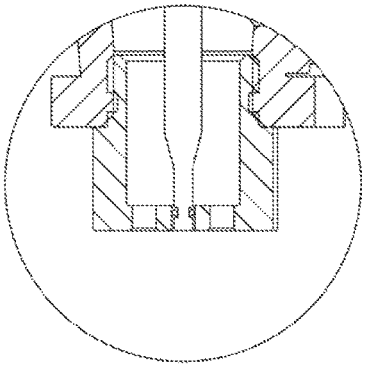

Embodiment 3: as shown in FIG. 30 and FIG. 31, in the embodiment, the lower end of the lower valve rod 27 is cylindrical, the nozzle exit is provided with a plurality of gas holes 35, the lower end of the lower valve rod is provided with an O-shaped seal ring 34, and in case of low-heating value gear, the lower valve rod departs away from the nozzle exit, so that all the gas holes are kept to be communicated with one another; in case of high-heating value gear, the lower valve rod downwards moves to make the lower end of the lower valve rod plug one of the gas holes, so that the effective gas inlet cross section of the nozzle exit is changed.

Figure 32:
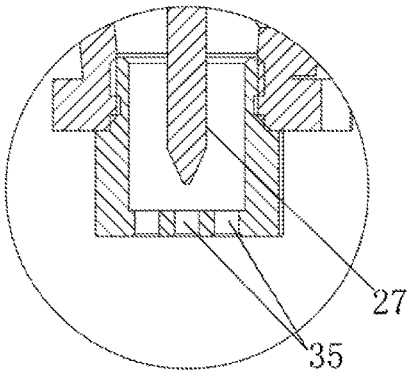
FIG. 32 and FIG. 33 are the structure schematic diagrams of the match between the lower valve rod and the nozzle in embodiment 4.
Figure 33:
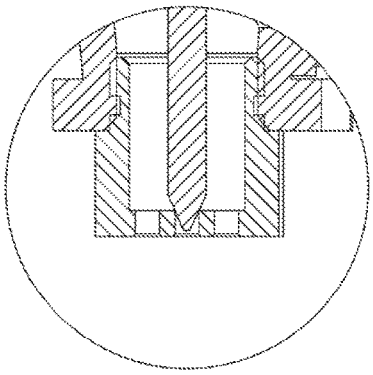

Embodiment 4: as shown in FIG. 32 and FIG. 33, in the embodiment, the lower end of the lower valve rod 27 is tapered, the nozzle exit is provided with a plurality of gas holes 35, in case of low-heating value gear, the lower valve rod departs away from the nozzle exit, so that all the gas holes are kept to be communicated with one another, and in case of high-heating value gear, the lower valve rod downwards moves to make the lower end of the lower valve rod plug one of the gas holes, so that the effective gas inlet cross section of the nozzle exit is changed.

Figure 34:
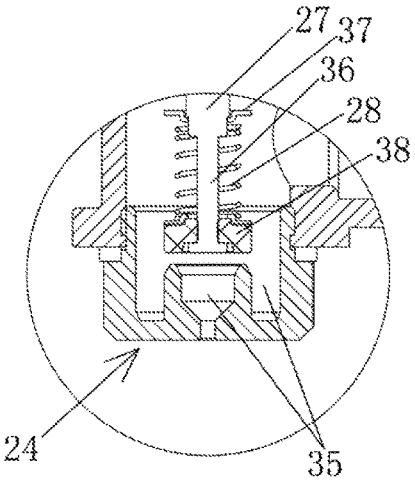
FIG. 34 and FIG. 35 are the structure schematic diagrams of the match between the lower valve rod and the nozzle in embodiment 5.
Figure 35:
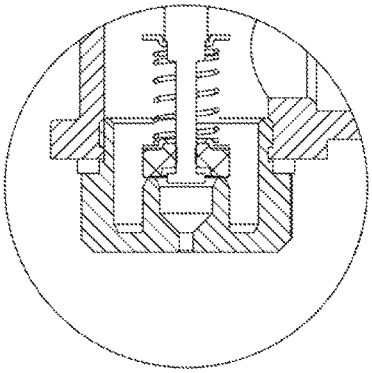

Embodiment 5: as shown in FIG. 34 and FIG. 35, in the embodiment, the lower part of the lower valve rod 27 is contracted into a push rod 36, the upper end of the push rod 36 is fixedly provided with a baffle ring 37, the lower end of the push rod 36 is movably provided with a seal cushion 38 in a covering way, the hermetic seal is kept between the seal cushion 38 and the push rod 36, a spring 28 is arranged on the push rod 36 in a covering way, the upper end and the lower end of the spring 28 respectively lean against the baffle ring 37 and the seal cushion 38, the nozzle exit 24 is provided with the plurality of gas holes 35, wherein the middle gas hole is inwards convex out of the nozzle exit 24, and in case of low-heating value gear, the lower valve rod 37 upwards moves to drive the seal cushion 38 depart away from the nozzle exit, so that all the gas holes are communicated with one another; in case of high-heating value gear, the lower valve rod 27 downwards moves to make the seal cushion 38 tightly pressed at the corresponding gas hole by the spring, so that the effective gas inlet cross section of the nozzle exist can be reduced.

Figure 20:
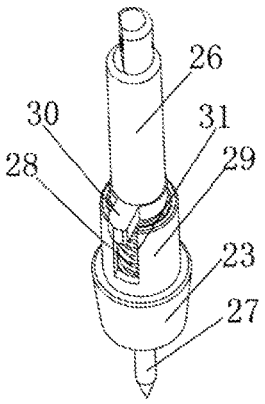
FIG. 20 is the structure schematic diagram of the match between the upper valve rod and the valve core.
Figure 21:
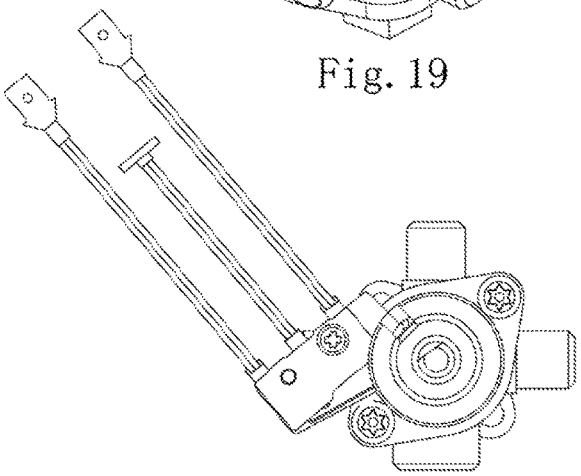
FIG. 21 is the overhead structure schematic diagram of FIG. 16.
Figure 22:
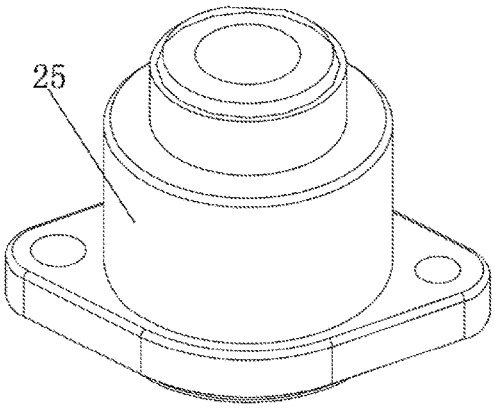
FIG. 22 is the three-dimensional structure schematic diagram of the valve cover.
Figure 23:
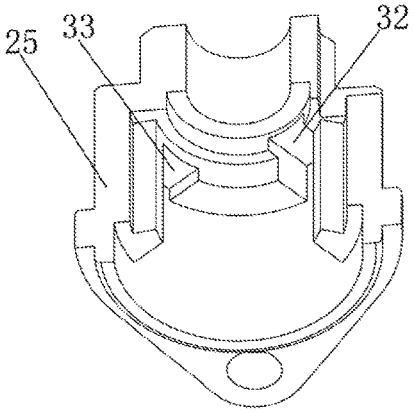
FIG. 23 is the structure schematic diagram of the inner part of the valve cover.
Figure 24:
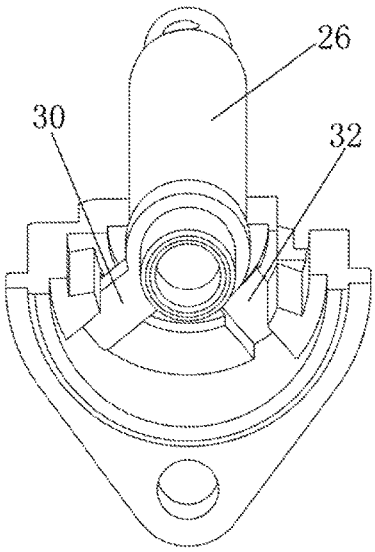
FIG. 24 is the schematic diagram when the lug boss on the upper valve rod is screwed into the high-heating value gas gear slot.
Figure 25:
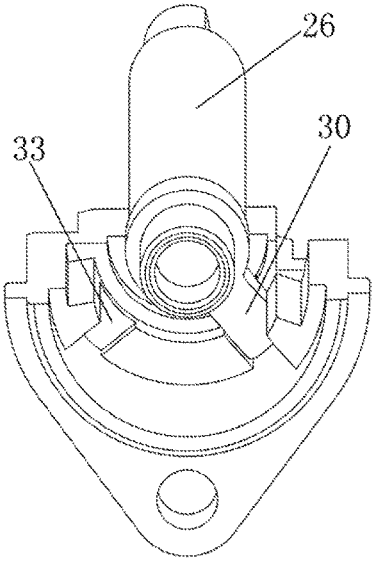
FIG. 25 is the schematic diagram when the lug boss on the upper valve rod is screwed into the low-heating value gas gear slot.
Figure 36:
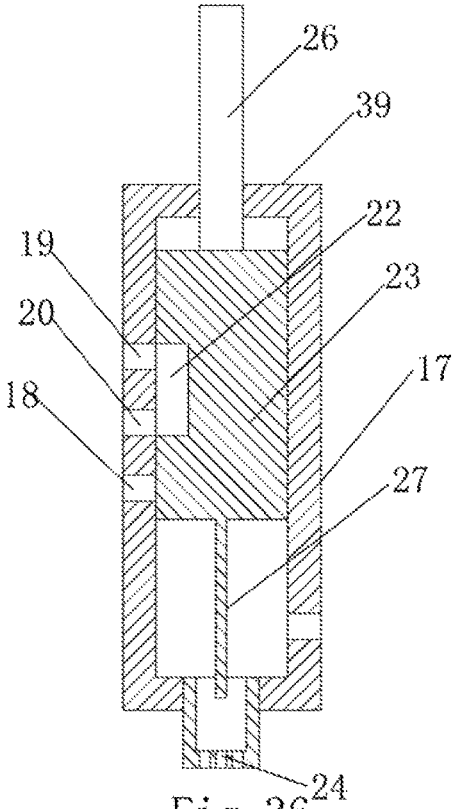
FIG. 36 and FIG. 37 are the schematic diagrams where the valve core is respectively switched into the low-heating value gas igniting end gear and the high-heating value gas igniting end gear in embodiment 6.
Figure 37:
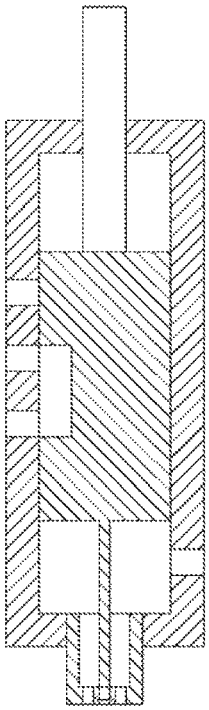

Embodiment 6: the principle of the embodiment is basically as the same as that of the embodiment 1, and the difference is the structure of the gas switcher, as shown in FIG. 36 and FIG. 37, the valve core 23 is arranged within the valve body 17 in a sliding way up and down, the lower valve rod 27 is fixedly connected with the valve core 23, the low-heating value gas igniting end gas outlet 19 and the high-heating value gas igniting end gas outlet 18 as well as the gas igniting end gas inlet 20 are arranged along the axial direction of the center of the valve core, and the gas igniting end gas inlet 20 is arranged between the low-heating value gas igniting end gas outlet 19 and the high-heating value gas igniting end gas outlet 18; the upper end of the valve body 17 is contracted into a support table 39, similar to the FIG. 20, the lug boss 30 is arranged on the upper valve rod 26, the spring 28 is covered on the upper valve rod 26, the upper end and the lower end of the spring 28 respectively lean against the support table 39 and the lug boss 30, similarly, the arrangement of the gear within the valve seat is as the same as that in embodiment 1, i.e. as shown in FIG. 22-FIG. 25, the cross section of the valve seat 25 is circular, the valve seat 25 is internally provided with a low-heating value gas gear slot 32 and a high-heating value gas gear slot 33, which are arranged with each other at different height in a staggered way, the upper valve rod 26 downwards moves to make the lug boss 30 clamped into the linkage notch 31, the upper valve rod 26 rotates to drive the valve core 23 rotate so as to switch between the high-heating value gas igniting end gas circle and the low-heating value gas igniting end gas circle, and the lug boss 30 is clamped into the corresponding gear slot as well to position the upper valve rod 26 and the lower valve rod 27.

Figure 38:
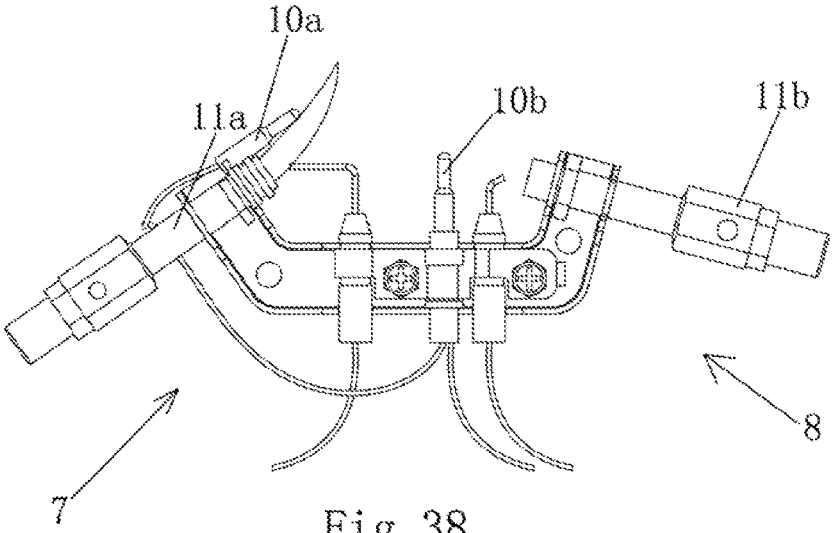
FIG. 38 is the state diagram when the high-heating value gas igniting end burns if the system induces the gas correctly in embodiment 7.
Figure 39:
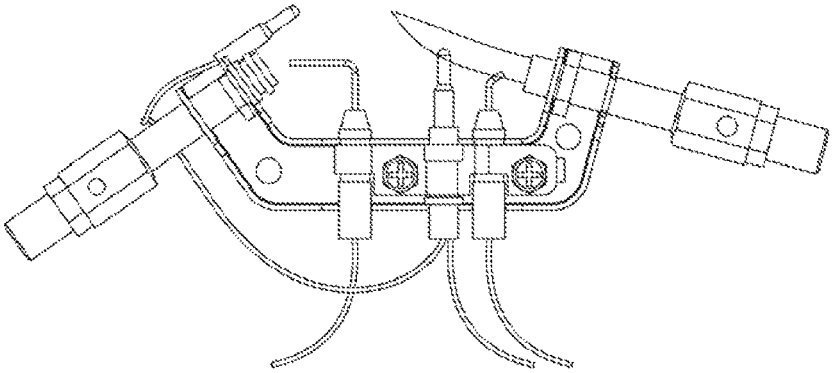
FIG. 39 is the state diagram when the low-heating value gas igniting end burns if the system induces the gas correctly in embodiment 7.
Figure 40:
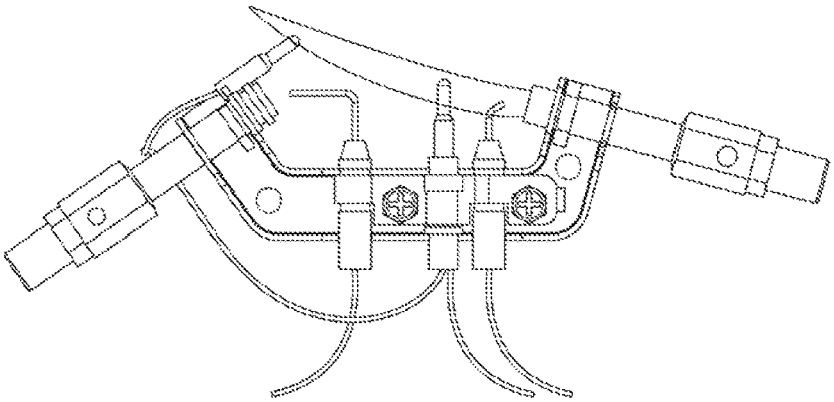
FIG. 40 is the state diagram when the low-heating value gas igniting end burns if the system induces the high-heating value gas into the low-heating value gas igniting end by mistake in embodiment 7.

Embodiment 7, as shown in FIG. 38-FIG. 40, in the embodiment, the high-heating value gas igniting end and the low-heating value gas igniting end are arranged at the same side of the main burner, the thermocouple 10*a* of the high-heating value gas igniting end is bound on the corresponding ignition burner 11*a*, the head of the thermocouple 10*a* is slightly inclined to the nozzle exit of the ignition burner 11*a*, and is over against the nozzle exist of the ignition burner 11*b* of the low-heating value gas igniting end, the head of the thermocouple 10*b* of the low-heating value gas igniting end is arranged in the middle of the connection between the nozzle exit of the ignition burner 11*b* and the head of the thermocouple 10*a*, when the gas is induced correctly, the fire jet out of the corresponding ignition burner heats up the adjoining thermocouple, and when the high-heating value gas is induced into the low-heating value gas igniting end by mistake, the fire jet out of the ignition burner 11*b* can heat up the two thermocouples 10*a* and 10*b* at the same time.

The control system and method provided by each embodiment of the present invention are explained above in details, the specific case is applied to describe the principle and the embodiment in the present invention, and the specification of the embodiments is only used to understand the method and the core idea of the present invention; meanwhile, those skilled in the field, according to the idea of the present invention, any possible change on the specific embodiment and the application scope, for example, the change of the installing relative position of each part of the igniting end, or the two ignition electrodes are replaced by one ignition electrode, or one of the two lead wires of the two thermocouples which are connected with each other in series is grounded, one end of the solenoid valve is lead backwards from a ground wire, and only one lead wire is connected with the solenoid valve in the control valve to form a loop, is accordant with the ideal of the present invention. In conclusion, the contents of the present invention should not be interpreted as the limit thereto.

What is claimed is:

1. A dual fuel ignition device, comprising:

a high-heating value gas igniting end, comprising a first thermocouple having a first cathode and a first anode and an ignition burner adapted to high-heating value gas, wherein the ignition burner is connected with a branch of a gas inducing gas flow;

a low-heating value gas igniting end, comprising a second thermocouple having a second cathode and a second anode and an ignition burner adapted to low-heating value gas, wherein the ignition burner is connected with another branch of the gas inducing gas flow, wherein the first cathode is directly connected to the second cathode or the first anode is directly connected to the second anode to output electric potential according to heating condition of the thermocouples;

fire of the ignition burner heats up the corresponding thermocouple only to generate the electric potential when the igniting end correctly induces the gas due to position configuration of the two thermocouples, and when the igniting end induces the high-heating value gas into the low-heating value igniting end by mistake, the fire heats up the two thermocouples at the same time to offset or reduce the output electric potential.

2. The dual fuel ignition device according to claim 1, wherein when the first anode and the second anode are connected with each other in series, the first cathode and the second cathode induce the electric potential;

when the first cathode and the second cathode are connected with each other in series, the first anode and the second anode induce the electric potential.

3. The dual fuel ignition device according to claim 1, wherein the high-heating value gas igniting end and the low-heating value gas igniting end respectively comprise an ignition electrode;

or the high-heating value gas igniting end and the low-heating value gas igniting end jointly use one ignition electrode.

4. The dual fuel ignition device according to claim 1, wherein the device comprises a control valve taken as a main switch to control the gas flow switched on or off, wherein the control valve is internally provided with a solenoid valve used for controlling the control valve switched on or off;

an output end of the control valve comprises two gas flow output, wherein one is the gas inducing gas flow for switching gear between ignition gas flow of high-heating value gas and low-heating value gas, and the other is a main gas flow leading to a main burner, furthermore, the main gas flow enters into the main burner through an adjustable nozzle and is ignited to be burned on the surface thereof, and the effective gas inlet cross section of the adjustable nozzle is controlled by a gas type selector device used for adjusting the gas flow to the high-heating value gas igniting end or to the low-heating value gas igniting end.

5. The dual fuel ignition device according to claim 4, wherein the gas type selector device comprises:

a valve body, wherein a low-heating value gas igniting end gas outlet, a high-heating value gas igniting end gas outlet, a gas igniting end gas flow gas inlet and a main gas inlet are arranged on the periphery of the valve body, the valve body is internally provided with a valve core where the periphery is upwards concaved to be provided with a notch, and the valve core moves to make the notch communicated with the low-heating value gas igniting end gas outlet and the gas igniting end gas flow gas inlet or the high-heating value gas igniting end gas outlet and the gas igniting end gas flow gas inlet;

an adjustable nozzle, which is communicated with a main gas inlet, and arranged at the lower end of the valve body, wherein the lower end of the adjustable nozzle is provided with a nozzle exit;

a valve seat, which is fixedly arranged at the upper end of the valve body, wherein the valve seat is internally provided with an upper valve rod in a sliding way, the upper end of the upper valve rod exposes out of the valve seat, the lower end of the upper valve rod is connected with a lower valve rod, and the lower valve rod penetrates through the valve core to downwards reach the nozzle exit;

the valve seat is internally provided with a spring which makes the upper valve rod reset, the upper valve rod downwards moves and drives the valve core move to switch between the high-heating value gas igniting end gas flow and the low-heating value gas igniting end gas flow, and the lower valve rod moves synchronously with the upper valve rod and is matched with the nozzle exit, so that the required effective gas inlet cross section of the nozzle exit corresponding to the high-heating value gas and the low-heating value gas can be adjusted.

6. The dual fuel ignition device according to claim 5, wherein the valve core and the valve body have taper angle respectively, the lower valve rod is in sliding match with the valve core, the upper end face of the vale core is provided with a housing which is integrated therewith, the spring is covered onto the upper valve rod and is arranged within the housing, a lug boss is arranged on the upper valve rod, the upper end and the lower end of the spring respectively lean against the lug boss and the valve core, a linkage notch matched with the lug boss is arranged on the housing, the valve seat is internally provided with a low-heating value gas gear slot and a high-heating value gas gear slot, which are arranged with each other at different height in a staggered way, the upper valve rod upwards moves to make the lug boss clamped into the linkage notch, the upper valve rod rotates simultaneously to drive the valve core rotated to switch between the high-heating value gas igniting end gas flow and the low-heating value gas igniting end gas flow, and the lug boss is clamped into the corresponding gear slot to position the lower valve rod as well.

7. The dual fuel ignition device according to claim 5, wherein the cross section of the notch is arc, the low-heating value gas igniting end gas outlet and the high-heating value gas igniting end gas outlet are arranged on the same straight line, and the igniting end gas inlet is arranged along the direction which is perpendicular to the straight line where the high-heating value gas igniting end gas outlet and the low-heating value gas igniting end gas outlet are arranged.

8. The dual fuel ignition device according to claim 5, wherein the lower end of the lower valve rod is tapered, in case of low-heat vale gear, the lower end of the lower valve rod departs away from the nozzle exit, and in case of high-heating value gear, the lower end of the lower valve rod is inserted into the nozzle exit, so that the effective gas inlet cross section of the nozzle exit is changed.

9. The dual fuel ignition device according to claim 5, wherein the lower end of the lower valve rod is cylindrical, the diameter of the lower end of the lower valve rod is less than that of the nozzle exit, and in case of low-heat vale gear, the lower end of the lower valve rod departs away from the nozzle exit;

in case of high-heating value gear, the lower end of the lower valve rod is inserted into the nozzle exit, so that the effective gas inlet cross section of the nozzle exit is changed.

10. The dual fuel ignition device according to claim 5, wherein the lower end of the lower valve rod is cylindrical, the nozzle exist is provided with a plurality of gas holes, the lower end of the lower valve rod is provided with an 0-shaped seal ring in a covering way, and in case of low-heat valve gear, the lower valve rod departs away from the nozzle exit, so that all the gas holes are communicated with one another;

in case of high-heating value gear, the lower valve rod downwards moves, so that one gas hole is plugged by the lower end of the lower valve rod, therefore, the effective gas inlet cross section of the nozzle exit can be changed.

11. The dual fuel ignition device according to claim 5, wherein the lower end of the lower valve rod is tapered, the nozzle exist is provided with the plurality of gas holes, in case of low-heat valve gear, the lower valve rod departs away from the nozzle exit, so that all the gas holes are communicated with one another, and in case of high-heating value gear, the lower valve rod downwards moves, so that one gas hole is plugged by the lower end of the lower valve rod, therefore, the effective gas inlet cross section of the nozzle exit is changed.

12. The dual fuel ignition device according to claim 5, wherein the lower part of the lower valve rod is contracted into a push rod, the upper end of the push rod is fixedly provided with a baffle ring, the lower end of the push rod is movably provided with a seal cushion in a covering way, a spring is arranged on the push rod in a covering way, the upper end and the lower end of the spring respectively lean against the baffle ring and the seal cushion, the nozzle exit is provided with the plurality of gas holes, and in case of low-heating value gear, the lower valve rod upwards moves to drive the seal cushion depart away from the nozzle exit, so that all the gas holes are communicated with one another;

in case of high-heating value gear, the lower valve rod downwards moves to make the seal cushion tightly pressed at the corresponding gas hole by the spring, so that the effective gas inlet cross section of the nozzle exist can be reduced.

13. A work method based on the ignition device according to claim 4, wherein when the igniting end induces the gas correctly, only the corresponding thermocouple can be heated up, so that the electric potential generated by the thermocouple makes a solenoid valve in a control valve switched on, therefore, the gas flow is communicated;

when the high-heating value gas igniting end induces the low-heating value gas by mistake, the ignition burner cannot be ignited or the thermocouple cannot be heated due to less fire, the thermocouple cannot generate the electric potential, and the solenoid valve in the control valve cannot be switched on, so that the gas flow is not communicated;

when the high-heating value gas is induced into the low-heating value gas igniting end induces by mistake, the fire jet out of the ignition burner of the low-heating value gas igniting device can be changed to be long abnormally, to heat up the two thermocouples at the same time, the two thermocouples can simultaneously generate the electric potential which can be offset and reduced, and the solenoid valve in the control valve cannot be switched on as well, therefore, the gas flow is not communicated.

14. A safety type dual fuel control system based on the ignition device according to claim 1, comprising a low-heating value regulator, a high-heating value regulator and:

a control valve, used for controlling the gas flow to be switched on and off, and respectively communicated with the low-heating value regulator and the high-heating value regulator, wherein the control valve is provided with two gas flow output, one is the igniting gas, the other is the main gas flow leading to the main burner, and the igniting gas leads to the high-heating value gas igniting end or the low-heating value gas igniting end by means of gas selector device;

the high-heating value gas igniting end and the low-heating value gas igniting end respectively comprise an ignition electrode;

or the high-heating value gas igniting end and the low-heating value gas igniting end jointly use one ignition electrode;

the high-heating value gas igniting end and the low-heating value gas igniting end further respectively comprise a thermocouple and an ignition burner which is respectively adapted to high-heating value gas and low-heating value gas, and anodes and cathodes of the two thermocouples are connected with the solenoid valve in the control valve after being connected with each other in series oppositely;

the fire of the ignition burner heats up the corresponding thermocouple only to generate the electric potential when the system correctly induces the gas due to the position configuration of the two thermocouples, so that the solenoid valve of the control valve can be kept to be switched on, and when the system induces the high-heating value gas into the low-heating value igniting end by mistake, the fire heats up the two thermocouples at the same time to offset or reduce the electric potential, so that the control valve is kept to be switched off.

15. The safety type dual fuel control system according to claim 14, wherein the in-series connection between the anodes as well as the cathodes of the two thermocouples and the solenoid valve in the control valve after the opposite in-series connection between the anodes and the cathodes of the two thermocouples means that:

the anodes of the two thermocouples are connected with each other in series, and the two cathodes are lead out to be connected with the solenoid valve in the control vale in series;

or the cathodes of the two thermocouples are connected with each other in series, and the anodes are lead out to be connected with the solenoid valve in the control vale in series.

16. The safety type dual fuel control system according to claim 1, wherein the ignition burner of the low-heating value gas igniting device is internally provided with an air window and a gas nozzle which is over against the air window, when the gas is jet out of the gas nozzle, the air window can generate the negative-pressure injection, a certain quantity of air can be charged to be mixed with the gas within the ignition burner so as to be jet out of the nozzle on the ignition burner and formed into the igniting fire by means of burning after being ignited by the ignition electrode.

17. A control method based on the ignition device according to claim 14, comprising:

when the system induces the gas correctly, only the corresponding thermocouple can be heated up, so that the electric potential generated by the thermocouple makes the solenoid valve in the control valve switched on, therefore, the gas flow is communicated;

when the system induces the low-heating value gas into the high-heating value gas igniter by mistake, the ignition burner cannot be ignited or the thermocouple cannot be heated due to less fire, the thermocouples cannot generate the electric potential, and the solenoid valve in the control valve cannot be switched on, therefore, the gas flow is not communicated;

When the system induces the high-heating value gas into the low-heating value gas igniting end by mistake, the fire jet out of the ignition burner of the low-heating value gas igniting device can be changed to be long abnormally, to heat up the two thermocouples at the same time, the two thermocouples can simultaneously generate the electric potential which can be offset or reduced, and the solenoid valve in the control valve cannot be switched on as well, therefore, the gas flow is not communicated.

18. The control method based on the ignition device according to claim 17, wherein when the system is correctly set, if the oxygen content of the atmosphere level falls below a specific level, the igniting gas is changed to be unstable and even extinguished, and the electro-dynamic potential generated by the thermocouples is reduced and even disappeared, so that the solenoid valve in the control valve which is connected with the thermocouple in series is released, the gas flow is not communicated, and the gas heater stop working, therefore, the safety can be guaranteed.

* * * * *